US006105719A

United States Patent [19]

Lensing

[11] Patent Number: 6,105,719

[45] Date of Patent: Aug. 22, 2000

[54] USER-CONFIGURABLE MECHANICS STOOL

[75] Inventor: Robert E. Lensing, Fort Smith, Ark.

[73] Assignee: REL Products Inc., Van Buren, Ark.

[21] Appl. No.: 09/186,090

[22] Filed: Nov. 5, 1998

[51] Int. Cl.[7] ..... E06C 7/16

[52] U.S. Cl. ..... 182/116; 182/127; 182/156; 280/32.5

[58] Field of Search ..... 182/115, 116, 182/127, 152, 156, 165, 180.1, 180.2, 180.3; 280/32.5, 32.6; 297/377; D6/360, 361

[56] References Cited

U.S. PATENT DOCUMENTS

| | | | |
|---|---|---|---|
| 2,701,168 | 2/1955 | Schemers | 182/116 |
| 2,767,897 | 10/1956 | Hoffman | 182/116 |
| 2,969,123 | 1/1961 | Jamerson et al. | 182/116 |
| 2,970,668 | 2/1961 | Snyder | 182/116 |
| 3,212,605 | 10/1965 | Dickerson | 182/152 X |
| 3,976,155 | 8/1976 | Esch | 280/32.5 X |
| 4,072,209 | 2/1978 | Bolts | 182/116 |
| 4,274,508 | 6/1981 | Hughes et al. | 182/116 |
| 4,298,093 | 11/1981 | Wing | 182/153 |
| 4,397,374 | 8/1983 | Rumage et al. | 280/32.5 X |
| 4,530,419 | 7/1985 | Rumage et al. | 182/106 |
| 4,542,806 | 9/1985 | Olson | 182/152 |
| 4,618,029 | 10/1986 | Lowry | 182/116 |
| 4,632,410 | 12/1986 | Bainbridge et al. | 280/32.5 |
| 4,660,237 | 4/1987 | Brodnax | 297/377 X |
| 4,727,958 | 3/1988 | Botello | 182/116 X |
| 4,867,273 | 9/1989 | Schaevitz | 280/32.5 X |
| 5,072,955 | 12/1991 | Holland et al. | 280/32.5 |
| 5,123,697 | 6/1992 | Szczurek | 297/377 X |
| 5,272,777 | 12/1993 | Favagrossa | 297/377 X |
| 5,370,204 | 12/1994 | Fox | 182/116 X |
| 5,701,979 | 12/1997 | Voich | 297/377 X |

*Primary Examiner*—Daniel P. Stodola
*Assistant Examiner*—Richard M. Smith
*Attorney, Agent, or Firm*—Stephen D. Carver

[57] ABSTRACT

A highly mobile support cart for automotive service personnel presents an elevated support platform over the engine compartment of a vehicle undergoing service. The wheeled frame, ideally supported by a smooth, concrete surface, comprises a rigid, transverse base from which rigid, elongated rails outwardly diverge. The frame mounts an extensible, slightly inclined ladder that supports the work platform. The frame rails and base are equipped with suitable caster wheel assemblies for locomotion. The divergent, reinforced frame design enhances stability and structural integrity. The extensible ladder transported by the frame projects upwardly from the rear. The ladder comprises a lower half pivoted to the frame that telescopingly receives a sliding upper half. Registered locking orifices are pinned by a spring biased clip system to lock the ladder halves against axial displacement. The locking clip comprises a generally C-shaped clasp that is yieldably, spring biased to a locking position. One end of the clasp penetrates aligned locking orifices in the ladder. Ladder orientation is established by a pivotal support brace angularly extending between the frame rails and the ladder. The brace terminates in a lower, transverse foot adapted to be cradled between aligned notches defined in supporting receptacle structure mounted on the frame rails.

1 Claim, 7 Drawing Sheets

USER-CONFIGURABLE MECHANICS STOOL

BACKGROUND OF THE INVENTION

I. Field of the Invention

The present invention relates generally to wheeled stools or dollies that aid mechanics during automotive servicing. More particularly, the present invention relates to portable, wheeled mechanics stools with elevated ladders of the type classified in United States Patent Class 280, Subclasses 32.5 and 32.6, and Class 182, Subclasses 106, 127, 129, 131, 132 and 152.

II. Description of the Prior Art

In the automotive repair arts, it has long been recognized that mechanics or service technicians must have unobstructed access beneath the vehicular chassis or frame. A variety of wheeled "creepers" exist for enabling the serviceman to lie down and slide underneath a vehicle. Whether known as creepers, crawlers, dollies or the like, such well-known support devices also provide a convenient seat that may be readily positioned about the vehicular periphery.

U.S. Pat. No. 2,692,636 shows a combination automobile mechanic's or creeper and stool. The creeper and stool therein disclosed utilizes coil spring members which connect a left and right platform to a center platform. The springs collapse the left and right platforms inwardly to convert the creeper into a stool. Suitable bolts lock the device in the desired position.

It is readily apparent that unobstructed access to the engine compartment of a vehicle undergoing service is highly desirable. Vehicular engine compartments vary greatly in dimensions and volume. Most engine compartments are crowded with numerous complex and hard-to-reach parts that are compactly fitted together. With common utility vehicles (i.e., "SUV's") and small pickup trucks most of the engine compartment is inaccessible without a ladder or some form of stool or lift. Four wheel drive trucks, and other vehicles that have high ground clearance, have engine compartments that are particularly difficult to access and service.

As a result, servicemen often use conventional step ladders or stools that were not originally designed for automotive use. It is not uncommon for the mechanic supported by inappropriate equipment to unsafely bend or reach for obscure parts. His instability may result in a fall or injurious contact with dangerous moving parts, high voltage electricity, or hot radiators or exhaust components. If the engine mechanic positions himself in an unstable disposition, tools or expensive parts will inevitably drop into the engine compartment, possibly contacting the rotating engine fan with significant violence. Worse yet, small fasteners or tools may drop into vital engine compartments if parts such as manifolds, spark plugs, or air cleaners, for example, have been removed. Of course, even minor mishaps like the dropping of tools or, parts upon the ground during service are a common, time-wasting vexation.

Without a support tool or ladder, engine technicians frequently lean over the sides or front of the vehicle. Usually a protective, resilient pad is first placed upon the fenders. Such cushions or mats are not completely effective. Often they do not protect enough of the exposed surface area. Often they have been soiled during their previous use. Even with such precautionary measures, however, the automotive surface has a good chance of being marred, scratched or smeared with oil. Even if the technician is neat and orderly, disadvantages with the latter approach exist. For example, when the mechanic assumes an abnormal position leaning over the fenders to access obscurely positioned parts, muscle strain or other injuries can ensue.

The increasingly numerous intricate parts used in late model motor vehicles merely aggravates the situation. Modem vehicles often require special servicing tools that must be carefully thrust through narrow access crevices or ports before an offending part may be reached. Many critical parts, such as distributors and air conditioning components such as evaporators are inconveniently placed within or adjacent the fire wall, in a position substantially blocked by the engine. Some modem V-8 engines that are transversely mounted within the engine compartment have four of their spark plugs almost completely blocked by the firewall. Thus a system enabling a mechanic to have comfortable and convenient access to the vehicle engine compartment is desirable.

U.S. Pat. No. 4,397,374 discloses structure aimed at providing easier access to the typical engine compartment. Therein disclosed is a support platform for standing or supporting the mechanic in a prone position.

U.S. Pat. No. 2,872,252 discloses an adjustable platform enabling a mechanic stand when adjacent to the motor vehicle. However the device requires frequent adjustments to the horizontal platform to achieve the desired working elevation. Moreover, the disclosed apparatus does not permit the entire mechanic's body to be supported thereon.

U.S. Pat. Nos. 2,970,668 4,072,209 disclose a mechanic's scaffold comprising angularly extended frames. Wheeled carts are known in the prior art. More specifically, U.S. Pat. No. 4,373,761 discloses a combined article mover and worker support. The device, as illustrated, comprises a plurality of stepped horizontal platforms or steps, at least one of which is supported by vertical frame members, while an upstanding handle is usable to support and maintain the balance of a worker standing on the uppermost step.

A number of prior art patent are specifically aimed at reaching the engine compartment from an overhead position. U.S. Pat. No. 4,964,487 discloses a horizontal support platform upon which the mechanic may lie as he pivots into position over the engine compartment. The support is secured to a pivotal frame horizontally extending from an anchored, and immobile, post. With such arrangement a vehicle being serviced must first be properly positioned relative to the work stand. With a mobile cart it is easier to achieve the desired work position, as the vehicle may be approached from any angle, and it may be parked anywhere in the service garage or facility.

U.S. Pat. No. 5,972,955 discloses a wheeled support dolly that comprises a plurality of platforms disposed at different elevations. The device lacks sufficient clearance to position a mechanic directly over a vehicle engine compartment.

U.S. Pat. No. reveals a relatively immobile service platform primarily adapted for servicing large diesel trucks. Although the support platform resembles a wheeled carriage, its major platform segments are fixed. Further, the platform elements do not position the mechanic directly over the engine compartment.

U.S. Pat. Nos. 4,867,273, 4,863,178, 4,397,374 and 4,727,958 illustrate similar mechanics dollies. All show a portable device having a wheeled support frame that may be thrust beneath a vehicle. Certain supports or extensions may be positioned, at least in part, above the engine compartment of a vehicle to be serviced.

U.S. Pat. No. 5,460,392 discloses a dolly having a wheeled, rectangular frame supporting an elevated table.

The table is extensible, and it can be positioned over an automobile motor and pivotally adjusted about a radial direction.

U.S. Pat. No. 4,530,419 discloses a wheeled dolly that has an angularly upwardly extending platform support. Because of the orientation of the vertical ladder, it is difficult to squarely position the support platform over an engine compartment.

U.S. Pat. No. 4,542,806 discloses a rigid, wheeled dolly of generally rectangular proportions. Wheeled frame members slide beneath the vehicle being serviced, and an upright vertical stanchion supports a projecting, horizontal platform above the vehicle engine compartment. Means are provide for vertically adjusting the platform. A similar "overhead" support dolly is seen in U.S. Pat. No. 4,618,029.

The fact that a wheeled, mechanic's dolly may provide a support directly above the engine compartment of a vehicle to be serviced is not, in and of itself, enough to remedy the problems n the prior art. An adequate design must be adjustable between a number of configurations that accommodate various vehicles of vastly different dimensions. Besides the requirement of elevational adjustability, a satisfactory dolly must be capable of assuming significantly different angular orientations to minimize the working distance between the user-mechanic and the target engine compartment. Further a satisfactory device must be highly stable, while concurrently allowing the user to safely work vertically (i.e., standing up), horizontally (i.e., lying on top of the support pad), and all configurations between. Further, an ideal machine must allow for angular and elevation adjustments without requiring the user to dismount the unit.

SUMMARY OF THE INVENTION

In the best mode my new mechanics stool comprises a rigid, wheeled frame mounting an extensible ladder that supports an elevated work platform above an engine compartment.

The frame is ideally supported upon smooth, concrete surfaces. The forwardly projecting frame comprises an upwardly extending, extensible ladder that supports an elevated service platform. When the frame rails are pushed under a vehicle to be serviced, the platform is disposed above the engine compartment within immediate reach of the mechanic, who may lean against or lie down upon the stool. The rigid steel frame comprises a rear, transverse base providing a step for initial access to the apparatus. A pair of rigid, diverging side rails project from the base towards the front. The rails and the base are equipped with suitable caster wheel assemblies for locomotion. The divergent, reinforced frame design enhances stability and structural integrity.

The extensible, two-piece ladder carried by the wheeled frame angularly projects upwardly towards the unit's front. A lower ladder half pivoted to the frame telescopingly receives an upper ladder half. Suitable locking orifices in the ladder are penetrated by a spring biased clip system that locks the ladder halves together in a given extended or retracted position. The locking clip comprises a generally C-shaped clasp that is yieldably, spring biased to a locking position. One end of the clasp penetrates aligned locking orifices in the ladder. A forwardly projecting platform for supporting a user mounts on top of the ladder. A tool pouch is suspended from the platform. The platform has a comfortable, resilient pad that provides a secure and comfortable support upon which a mechanic may rest.

Ladder orientation is determined by a pivotal support brace. The brace is suspended by a transverse rod supporting parallel sides that extend downwardly to a transverse, foot. The terminal foot is cradled by and between suitable aligned notches defined in a supporting receptacle. The receptacle has cooperating notched portions mounted on each frame rail. Once proper ladder orientation is chosen, the support brace foot is mated to the receptacle system to preserve alignment.

Thus, a fundamental object of my invention is to ease the service burden faced by mechanics or other service technicians when confronting automotive engine compartments.

Another fundamental object of my invention is to provide a convenient, wheeled cart that comfortably supports a mechanic or other service technician over an automotive engine compartment.

A related object is to provide a wheeled cart that readily facilitates access to parts and equipment within automotive engine compartments of a variety of sizes and configurations.

A related object is to provide a service cart of the character described that may readily be positioned in any desired position relative to that portion of the vehicle being serviced. It is a feature of my cart that it is not limited in use to engine servicing, but instead may be used to provide access to a variety of vehicular structures.

Another important object is to provide a versatile, wheeled support cart for mechanics that makes it easier to access automotive components that are ordinarily hard to reach.

Another important object is to provide a cart of the character described that may be adjusted vertically and angularly to adapt itself for use with vehicles of different sizes and, types, and dimensions.

A related object is to provide supporting platform that is adjustable in height.

Another object of the present invention is to provide a versatile support stool that reduces the likelihood that a mechanic will face back pain, muscle stress and other physical discomfort often associated with conventional automotive service routines.

Another object is to reduce the chances of scratching or marring the vehicle body by rendering it unnecessary for the automotive mechanic or service technician to rest upon or lean against any portion of the vehicle's body during service.

Yet another object is to conveniently support the mechanic or technician over the engine compartment while readily providing complete access to all parts or components requiring service.

A still further object is to provide a versatile and comfortable support that surmounts a vehicular engine compartment without obstructing necessary movements of the mechanic's arms or hands.

Another important object is to prevent operator injury by helping to avoid improper contact with hot or dangerous engine parts.

Yet another object is to provide a wheeled service cart of the character described that is highly stable, even when heavily weighted and/or disposed in oblique angular configurations. Another object to provide a cart of the character described that is readily transformable between different configurations.

A related object is to provide a versatile service cart that enables mechanics to assume a variety of working positions. It is a feature of this invention that the mechanic may stand if desired, seat himself, or lay in a prone position on top of the apparatus.

Another object is to provide a versatile mechanics dolly that ails in the handling and conveyance of heavy parts.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
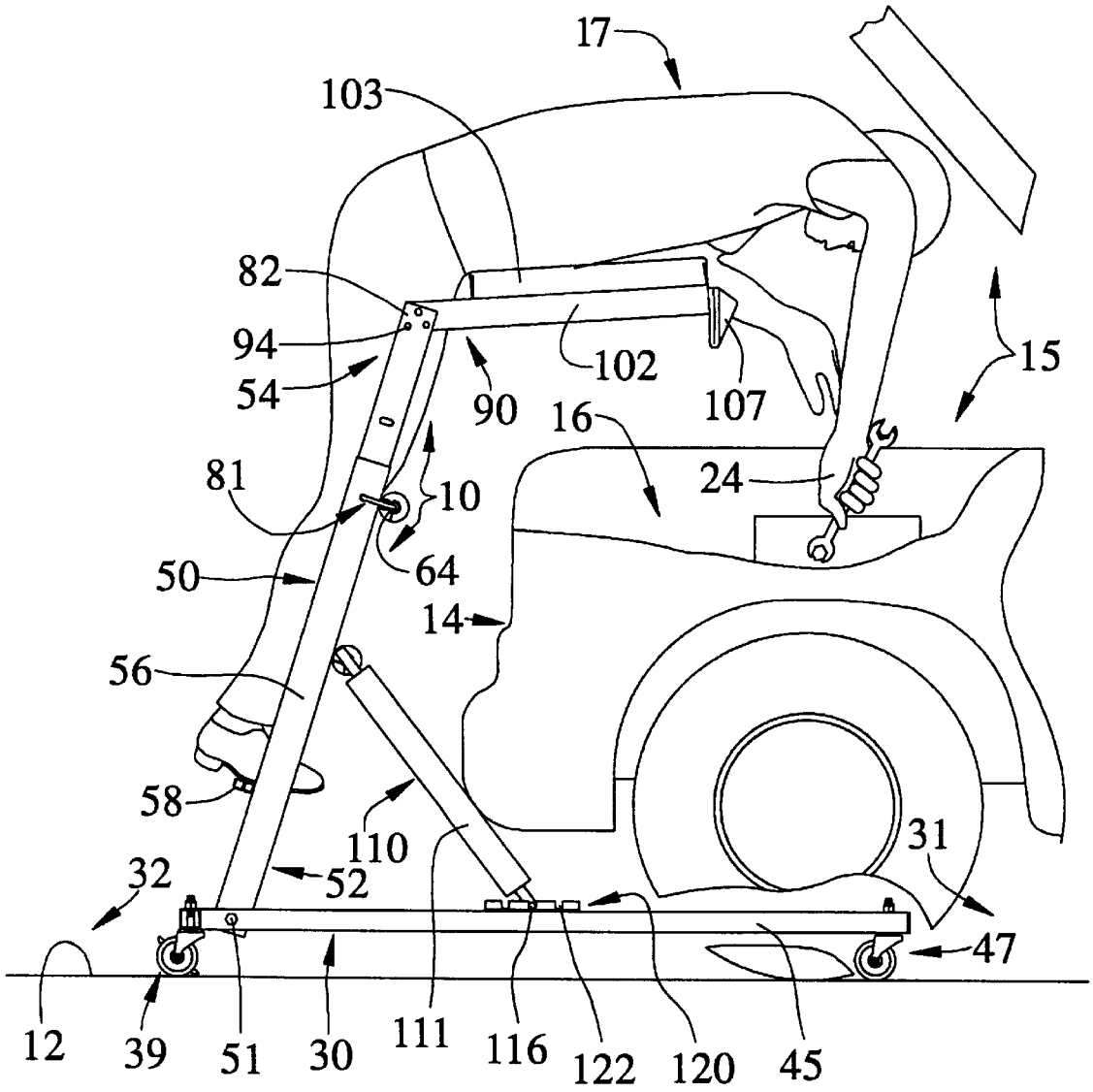
FIG. 1 is a side elevational view of the preferred user configurable mechanics stool.

With initial reference directed to FIGS. 1–4 of the appended drawings, my new mechanics stool has been generally designated by the reference numeral 10. The preferably wheeled stool is best supported upon a smooth, concrete supporting surface 12 (FIG. 1) so that it may be moved into a convenient position adjacent front 14 of truck 15 or any other vehicle requiring service. Through use of my stool, the engine compartment 16 is immediately exposed to mechanic 17, who may support himself upon the stool. As illustrated, mechanic 17 has rested his torso upon the upper support while partially standing. The user may stand or lie down upon the apparatus as desired. Prior to beginning work, the machine must be properly adjusted and set up. As explained hereinafter, the supporting ladder will be extended or retracted and then locked at desired height so as to place the user's hands 24 as close as possible to vital parts. The ladder angle must also be adjusted for optimum comfort, by adjusting the support brace, as hereinafter described.

Figure 2:
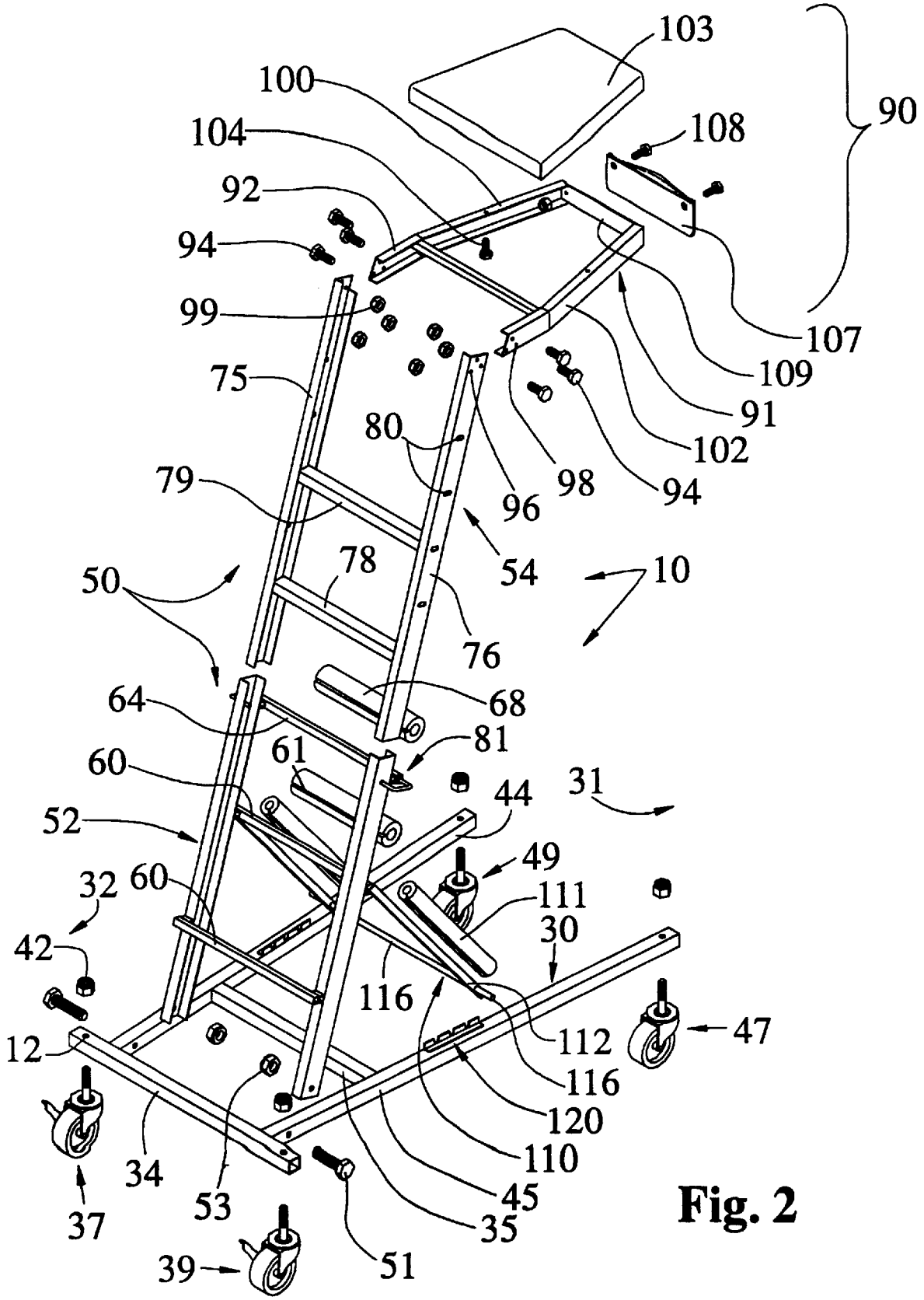
FIG. 2 is an enlarged, fragmentary, exploded isometric view thereof, with the ladder fully extended.
Figure 3:
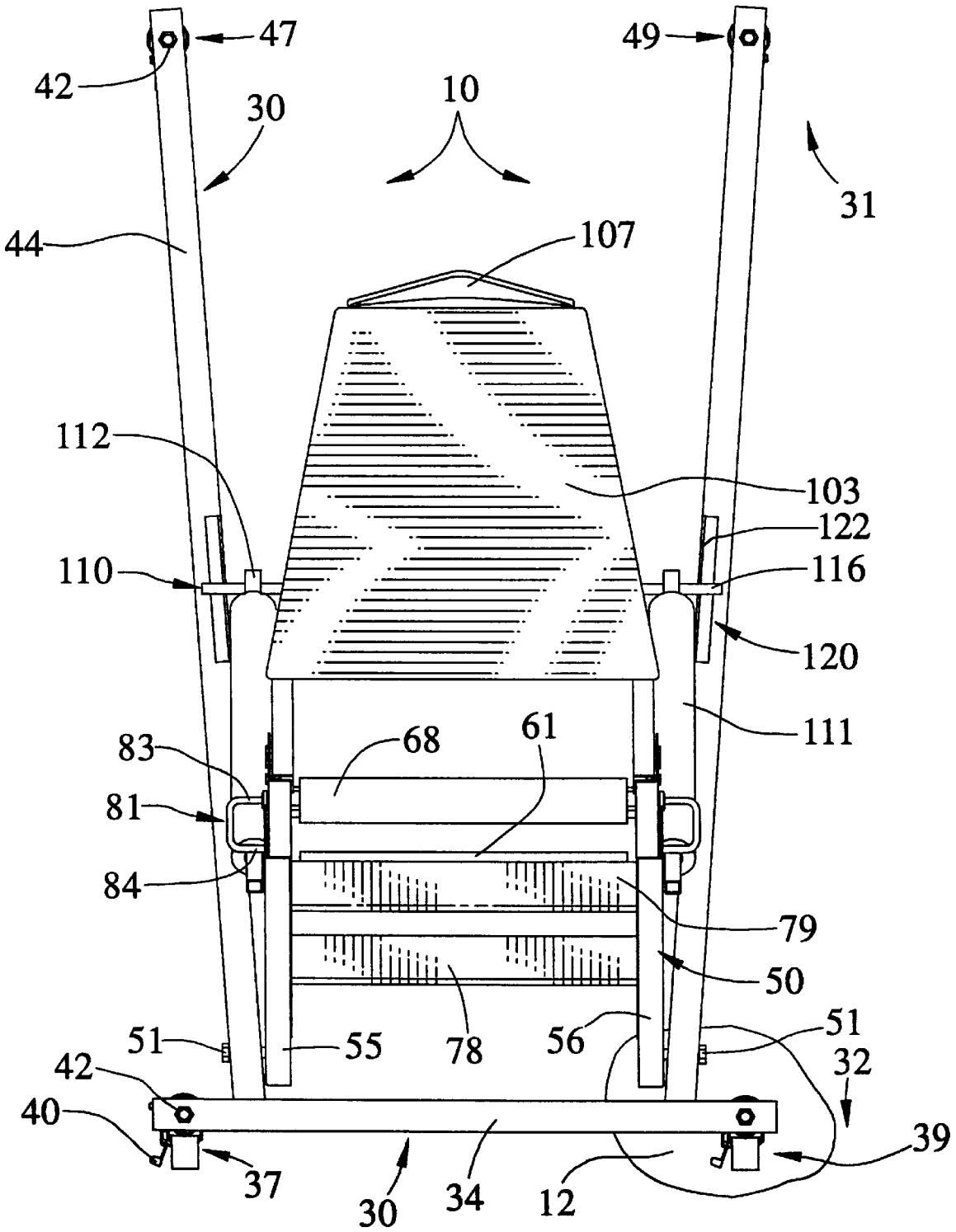
FIG. 3 is an enlarged, top plan view of my mechanics stool disposed in a deployed position.

The preferably steel, wheeled frame 30 comprises a front 31 and a rear 32 corresponding to the front and rear of the stool. A rigid, transverse base 34 forming the frame rear is terminated at its opposite ends in suitable caster wheel assemblies 37, 39 that are equipped with foot operated locks 40. The caster wheel assemblies are all mounted similarly. Assembly 37, for example, has a threaded shaft 38 received through a suitable orifice 41 in the frame that is secured by a suitable lock-bolt 42 (FIG. 2). Frame base 34 provides a step for initial access to the apparatus. It is complemented by a forwardly spaced apart reinforcement 35 (FIG. 2).

Frame 30 also comprises a pair of rigid, spaced-apart, side rails 44, 45 that project towards the apparatus front 31. These non-parallel rails form a divergent angle between them. The side rails terminate at their front extreme in caster wheel assemblies 47, 49 (FIG. 3) that are similar to assemblies 37, 39 discussed above. Through the preferred frame construction disclosed, stability and structural integrity are enhanced.

An extensible, preferably two-piece ladder 50 extends angularly upwardly from the frame 30. Ladder 50 comprises a lower half 52 that is pivoted to the frame, and an upper half 54 that is telescopingly, slidably coupled to lower half 52. The lower ladder half 52 has parallel, spaced apart sides 55, 56 (FIG. 2) formed of channel steel. Suitable fasteners 51 (FIG. 2) mount the ladder by penetrating suitable, aligned orifices in the framework (FIG. 2), being retained by locking nuts 53. A transverse step bar 58 extending between ladder lower half sides 55, 56 is preferably welded to the rearmost (i.e., the outer) edges of ladder sides 55, 56. Besides providing reinforcement, bar 58 functions as an initial ladder step. A transverse rod 60 disposed above bar 58 extends between the forward edges 55A, 56A (FIG. 4) of the lower ladder half sides 55, 56. Rod 60, which is journaled for rotation by suitable mounts 62 (FIG. 4), is part of the adjustable support brace to be described in detail hereinafter. It is preferably covered coaxially by a cylindrical tube 61 (FIGS. 2, 4) made of resilient padding.

Figure 4:
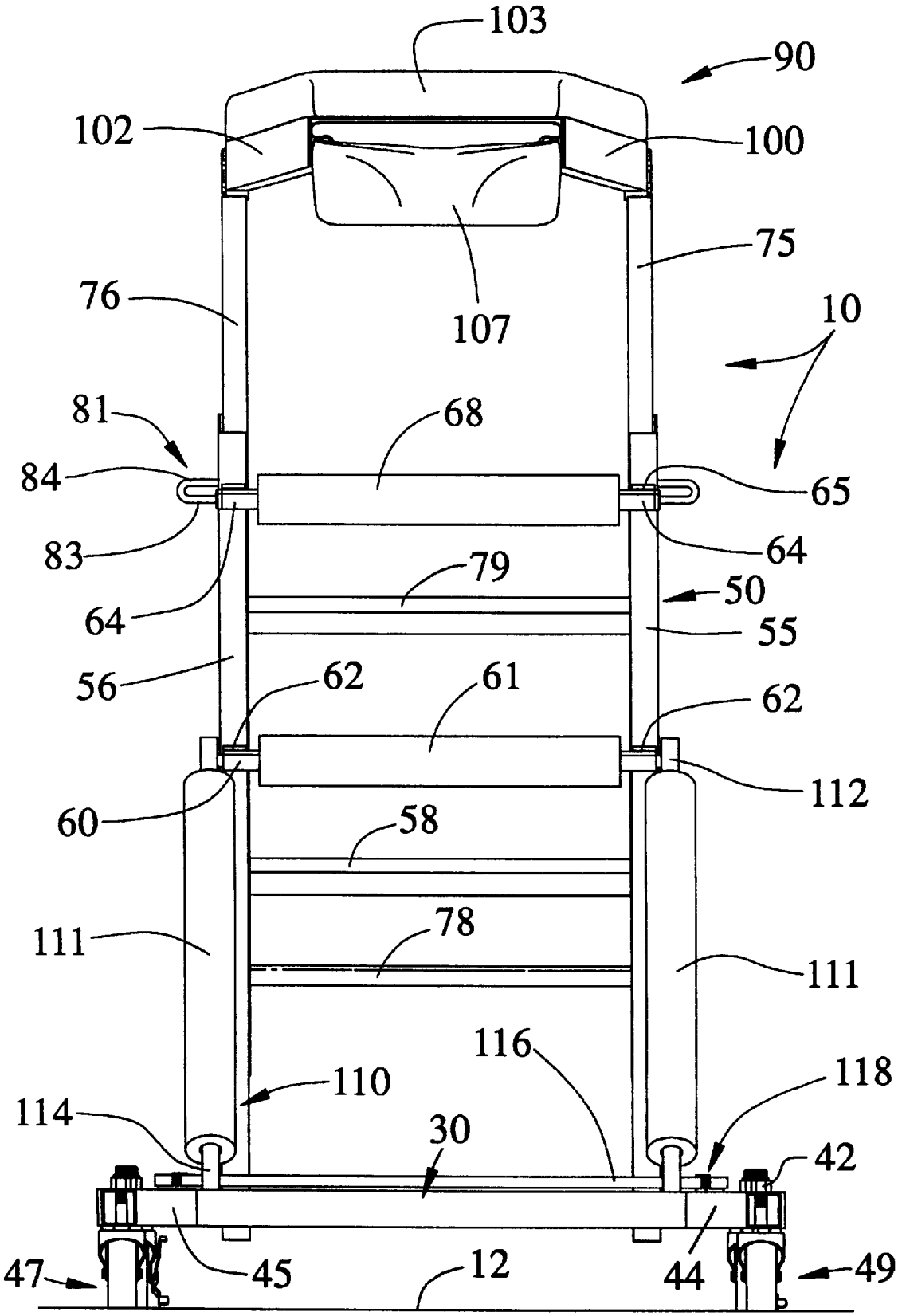
FIG. 4 is an enlarged front plan view thereof.
Figure 5:
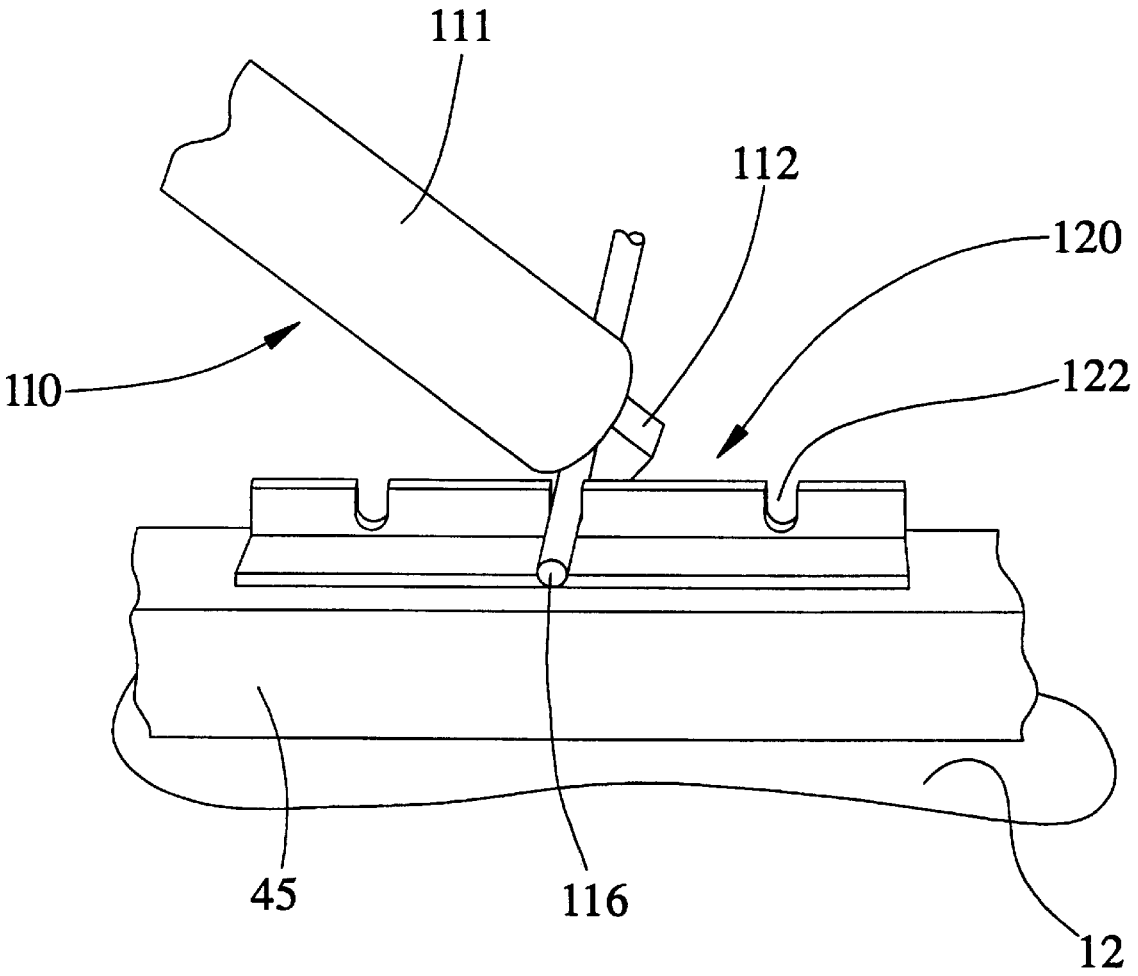
FIG. 5 is an enlarged, fragmentary isometric view of the preferred receptacle that locks the ladder brace.
Figure 6:
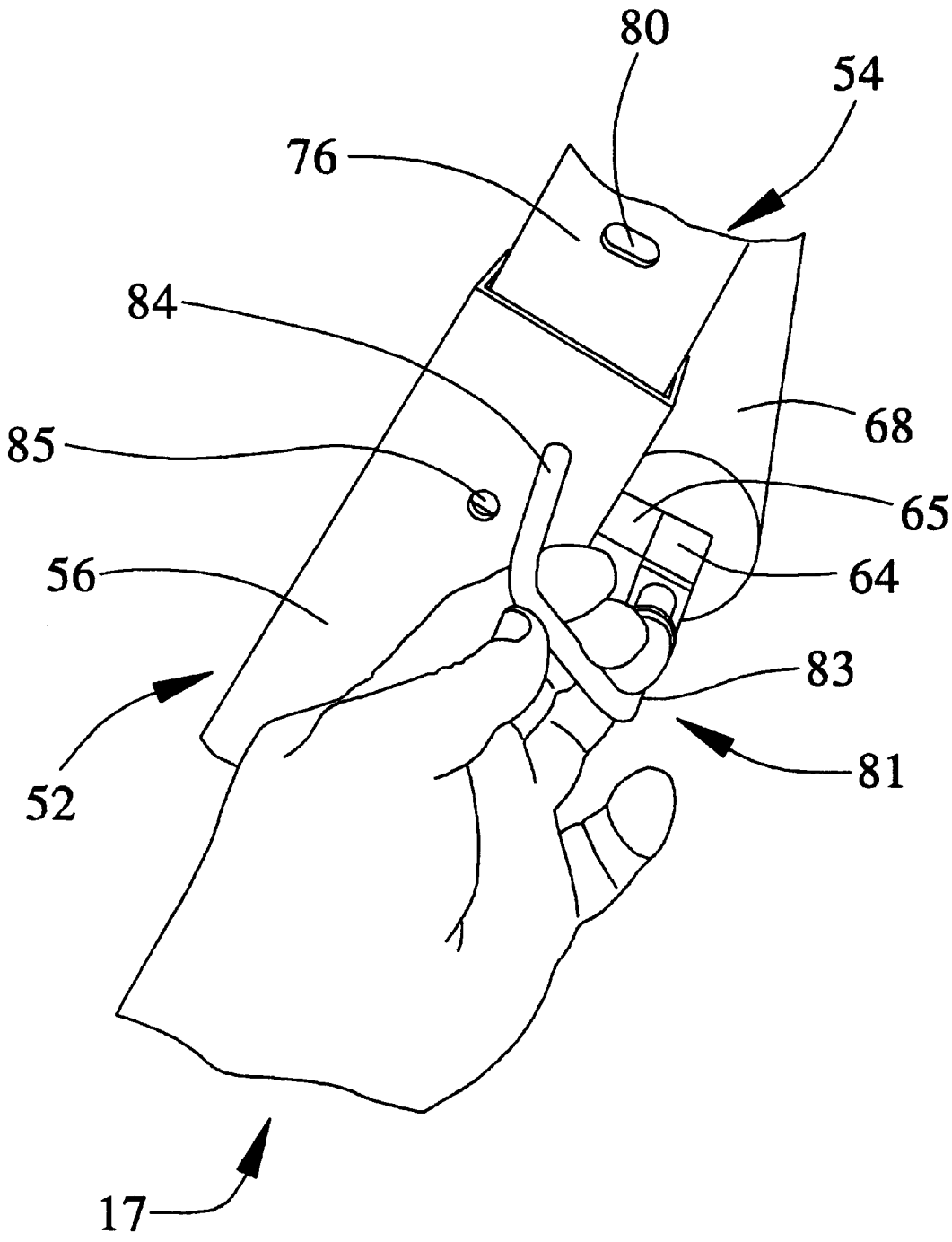
FIG. 6 is an enlarged, fragmentary pictorial view showing how the preferred locking clip is manipulated to establish the chosen ladder length; and, FIG. 7 is a side elevational view showing the mechanics stool folded into a collapsed, storage position.
Figure 7:
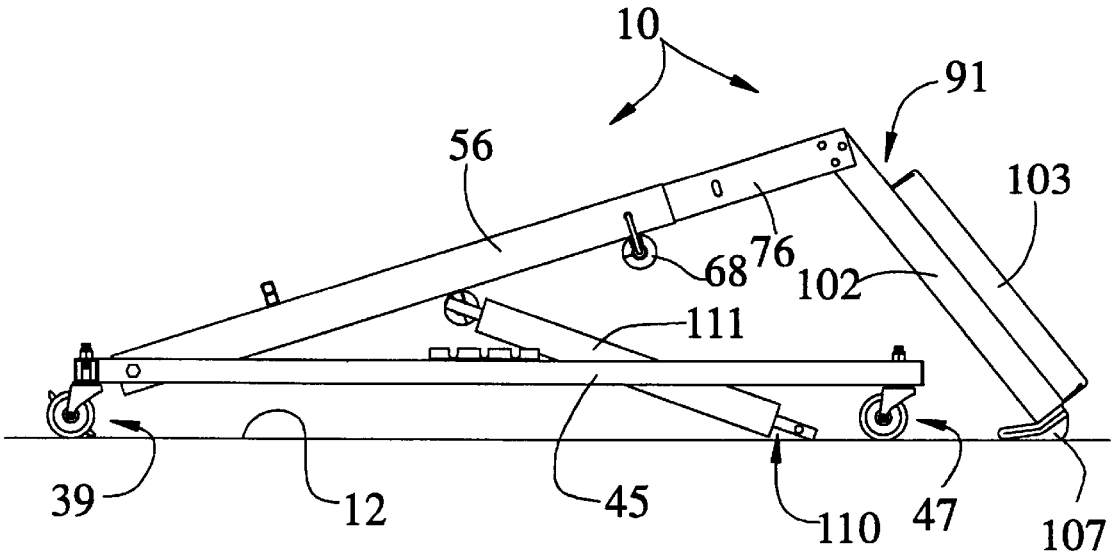

Finally, sides 55, 56 of the lower ladder half 52 are connected at their tops along their rearmost (i.e., the outer) edges by an elongated bar 64 that is welded to offset mounting brackets 65 (FIG. 4). Bar 64 is preferably covered coaxially by a cylindrical tube 68 (FIGS. 2, 4) made of resilient padding. The user activated clip system to be described hereinafter is associated with bar 64.

The upper ladder half 54 comprises parallel, spaced apart sides 75, 76 that are dimensioned to telescopingly fit within lower half ladder sides 55, 56 respectively. Upper ladder half 54 comprises a lower step 78 and an upper step 79 that are parallel and vertically spaced apart from one another. Steps 78, 79 extend between the inner portions of the interior channels presented by sides 75, 76 for clearance purposes. Thus, the upper ladder half 54 may be moved vertically relative to the lower ladder half 52 while slidably captivated between and within the lower halfs channel sides.

To maintain the appropriate ladder length, orifices 80 in the sides of upper half 54 are selectively engaged by the user-activated locking clip 81. Clip 81 comprises a generally C-shaped clasp, having one side 83 spring captivated within rod 64 previously discussed (FIGS. 2, 4) and a companion side 84 that can be twisted into position and directed though an orifice (not shown) in the side of the lower ladder halves and registered with selected ones of the orifices 80 in the upper ladder half, as previously discussed. The clips 81 may be activated manually, by gentle pulling, and ladder extension or retraction may thus be conveniently controlled by a user without completely dismounting from the apparatus.

A forwardly projecting platform for supporting a user has been generally designated by the reference numeral 90 (FIGS. 2, 4). Platform 90 comprises a generally A-shaped subframe 91 having rear legs 92 that are secured to the top portions 82 of the upper ladder sides 75, 76 by fasteners 94 (FIGS. 1, 2, 4) that penetrate aligned orifices 96, 98 to be fastened by locking bolts 99. A resilient, generally trapezoidal support pad 103 is fastened atop sides 100, 102 of the platform subframe 91 with suitable fasteners 104 (FIG. 2). The front cross piece 109 of subframe 91 mounts a tool pouch 107 that is secured by fasteners 108. As seen in FIG. 1, the platform 90 thus provides a secure and comfortable support upon which the mechanic 17 may rest or lean.

Ladder orientation is determined by the pivotal support brace system 110 that is suspended by rod 60 previously discussed. System 110 comprises parallel sides 112, 114 (FIG. 4) that extend from outer ends of rod 60 downwardly to a transverse, rod-like foot 1 16 that spans the distance between the frame rails 44, 45. These sides are preferably covered by a resilient coaxially fitted pad 111. Foot 116 is ideally captivated within suitable aligned notches presented by a mating receptacle 118 having cooperating, aligned portions mounted on top of each frame rail (FIGS. 1, 2). Note the plurality of spaced apart, receptive notches 122 formed in the receptacle system 120. When the proper angular orientation of the ladder system is chosen by the mechanic, the support brace is coupled to the receptacle system 120 to maintain desired alignment. Specifically, the support brace foot 116 is forcibly cradled by and between aligned notches 122 in the receptacle portions on opposite frame rails. It will be apparent that a plurality of desired angular positions are possible.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

Many possible embodiments may be made of the invention without departing from the scope thereof, and therefore it is to be understood that all matter herein set forth or shown in the accompanying drawings is to be interpreted as illustrative and not limiting.

What is claimed is:

1. A user-configurable mechanics stool comprising:

a wheeled frame adapted to be disposed on a supporting surface, the frame comprising a front, a rear, a transverse base at said rear upon which a user may step for access, and a pair of spaced apart side rails rigidly projecting towards said front, said side rails diverging away from one another as they extend away from said base towards the front of said stool to increase stability;

an extensible ladder extending angularly upwardly from said frame, the ladder comprising a lower half pivotally coupled to said frame, an upper half slidably telescoped to said lower half and adapted to be extended or retracted, the upper half and the lower half each comprising a plurality of spaced-apart orifices, one pair of said upper half orifices adapted to register with a corresponding pair of lower half orifices when the ladder is deployed at a desired length;

a forwardly projecting platform on top of said ladder and secured to said ladder upper half adapted to be disposed in a user-selected position over an engine compartment of a vehicle being serviced;

a user-activated clip for releasably locking said upper ladder half to said lower ladder half when deployed in a user-selected extended or retracted position, said clip comprising an end adapted to penetrate said spaced-apart orifices when the ladder is deployed in a desired length;

an adjustable support brace for securing the ladder in a desired angular position, the brace comprising a pair of parallel, spaced apart sides extending from said ladder downwardly towards said frame rails and comprising a rod-like terminal foot;

receptacle means mounted upon said frame rails for receiving the terminal foot on said brace and yieldably locking the brace in a desired angular position, the receptacle means comprising a plurality of spaced apart notches adapted to receive portions of said terminal foot to yieldably lock the ladder in a desired angular orientation; and, said terminal foot being of a length sufficient to span the frame rails in the vicinity of the receptacle means, but being insufficient in length to span the frame rails beyond the receptacle means to permit the stool to assume a low profile shape for storage.

* * * * *